US009188898B2

(12) United States Patent
Kobayashi

(10) Patent No.: US 9,188,898 B2
(45) Date of Patent: Nov. 17, 2015

(54) CONDUCTIVE ROLLER AND IMAGE FORMING APPARATUS HAVING THE SAME

(71) Applicant: KYOCERA Document Solutions Inc., Osaka-shi, Osaka (JP)

(72) Inventor: Kiyotaka Kobayashi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/334,000

(22) Filed: Jul. 17, 2014

(65) Prior Publication Data

US 2015/0023698 A1 Jan. 22, 2015

(30) Foreign Application Priority Data

Jul. 22, 2013 (JP) ..... 2013-151301

(51) Int. Cl.
*G03G 15/02* (2006.01)
*G03G 15/16* (2006.01)

(52) U.S. Cl.
CPC ..... *G03G 15/0216* (2013.01); *G03G 15/0208* (2013.01); *G03G 15/0233* (2013.01); *G03G 15/1685* (2013.01); *G03G 2221/183* (2013.01)

(58) Field of Classification Search
CPC ..... G03G 15/02
USPC ..... 399/176
See application file for complete search history.

(56) References Cited

U.S. PATENT DOCUMENTS

| | | | | | |
|---|---|---|---|---|---|
| 5,506,745 | A * | 4/1996 | Litman | ..... | 361/225 |
| 5,561,507 | A * | 10/1996 | Shelffo et al. | ..... | 399/237 |
| 6,449,449 | B1 * | 9/2002 | Kadonaga | ..... | 399/176 |
| 2011/0200361 | A1 * | 8/2011 | Gilmartin et al. | ..... | 399/176 |
| 2015/0023698 | A1 * | 1/2015 | Kobayashi | ..... | 399/176 |

FOREIGN PATENT DOCUMENTS

| | | | | | |
|---|---|---|---|---|---|
| JP | 1994-28860 | * | 4/1994 | ..... | G03G 15/02 |
| JP | 199428860 | U | 4/1994 | | |

* cited by examiner

*Primary Examiner* — Clayton E LaBalle
*Assistant Examiner* — Kevin Butler
(74) *Attorney, Agent, or Firm* — Alleman Hall McCoy Russell & Tuttle LLP

(57) ABSTRACT

A conductive roller includes a roller body, a spindle, and at least one groove. The roller body contacts with an outer circumferential surface of an image carrier, and is conductive. The spindle is provided in a center of the roller body. The groove is formed in each of side walls of the roller body at opposite ends in an axis direction of the roller body, and extends outward in a radial direction from the spindle.

5 Claims, 4 Drawing Sheets

CONDUCTIVE ROLLER AND IMAGE FORMING APPARATUS HAVING THE SAME

INCORPORATION BY REFERENCE

This application is based upon and claims the benefit of priority from the corresponding Japanese Patent Application No. 2013-151301 filed on Jul. 22, 2013, the entire contents of which are incorporated herein by reference.

BACKGROUND

The present disclosure relates to a conductive roller which contacts with an image carrier while being used, and an image forming apparatus including the conductive roller.

Conventionally, there is known an image forming apparatus, such as a copier, printer, or facsimile, that is based on the electrophotographic method. The image forming apparatus includes: a drum-type photoreceptor (image carrier); and a charging device, exposing device, developing device, transfer device and the like that are arranged along the outer circumferential surface of the photoreceptor. A general image forming process performed by the image forming apparatus is as follows. First, the charging device charges the surface of the photoreceptor to a predetermined potential (hereinafter also referred to as "charging bias"), and subsequently the exposing device irradiates a laser beam onto the surface of the photoreceptor. This causes an electrostatic latent image to be formed on the surface of the photoreceptor, due to the difference in potential between the portions to which the laser beam has been irradiated, and the other portions. The developing device subsequently adheres toner, which has been charged to a potential higher than the potential of the electrostatic latent image, to the electrostatic latent image. After this, the transfer device gives charge, which has a polarity that is opposite to the charging bias, to the rear surface of a sheet of material having been transported to a predetermined transfer position, thereby transferring a toner image onto the surface of the sheet of material.

As the above-mentioned charging device, there is known a charging roller that conducts a voltage to the surface of the photoreceptor by contacting with the surface of the photoreceptor. The charging roller includes: a roller body that is made of a conductive rubber material and has a cylindrical shape; and a spindle that is current conductive and provided in the center of the roller body. For the photoreceptor to be charged uniformly without unevenness, the surface of the charging roller is required to have high flatness. However, it is difficult for the machining technology to manufacture a charging roller whose surface has high flatness. In particular, cutter blades or the like are used to cut the material into a predetermined size, the cut portions becoming the opposite ends in the axis direction of the roller body. In this cutting process, the opposite ends of the roller body may be influenced by the elasticity of the rubber material of the roller body and the opposite ends of the roller body may be swollen. When the charging roller with swollen ends contacts with the photoreceptor, the ends of the charging roller are pressed harder to the photoreceptor than the other portions of the charging roller. As a result, the photoreceptor is not charged uniformly. With regard to this problem, a typical mechanism is known that can reduce the pressing force of the ends of the charging roller that presses the photoreceptor when the charging roller contacts with the photoreceptor.

SUMMARY

A conductive roller according to one aspect of the present disclosure includes a conductive roller body, a spindle, and at least one groove. The roller body contacts with an outer circumferential surface of an image carrier, and is conductive. The spindle is provided in a center of the roller body. The groove is formed in each of side walls of the roller body at opposite ends in an axis direction of the roller body, and extends outward in a radial direction from the spindle.

An image forming apparatus according to another aspect of the present disclosure includes the conductive roller.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the attached drawings.

[Structure of Image Forming Apparatus 1]

First, the structure of an image forming apparatus 1 (an example of the image forming apparatus of the present disclosure) is described with reference to FIG. 1.

Figure 1:
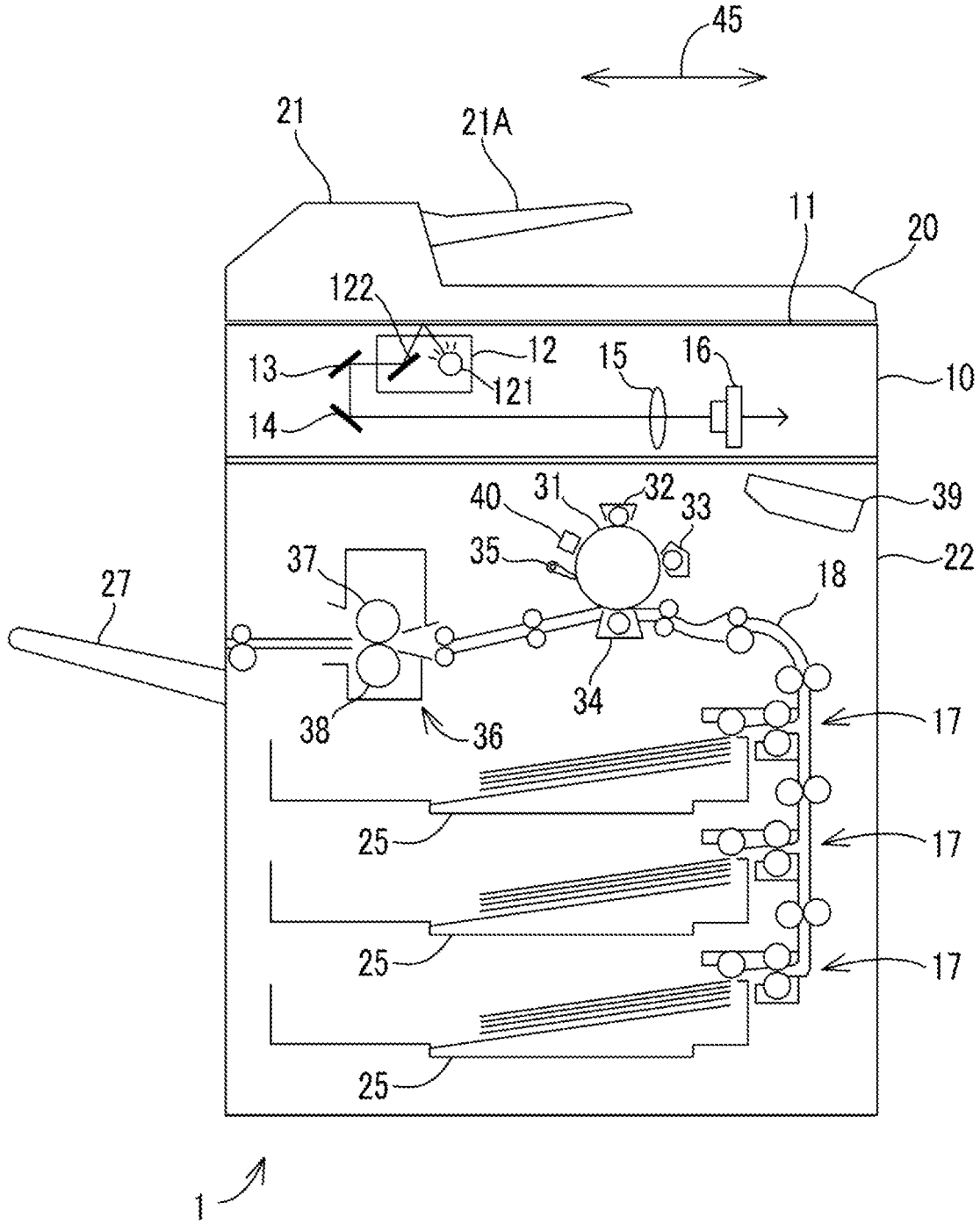
FIG. 1 is a diagram schematically showing the structure of the image forming apparatus in the embodiment of the present disclosure.

The image forming apparatus 1 shown in FIG. 1 is a multifunction peripheral having functions of a printer, a copier, a facsimile and the like. The image forming apparatus 1 prints an image on a printing paper sheet (a sheet of material) based on input image data by using a developer such as toner. The image forming apparatus 1 includes an image reading portion 10 in an upper portion thereof and an image forming portion 22 in a lower portion thereof, wherein the image reading portion 10 reads an image from an original sheet, and the image forming portion 22 forms images by the electrophotographic method. Note that although the present embodiment describes a multifunction peripheral as one example of the image forming apparatus of the present disclosure, the image forming apparatus of the present disclosure is not limited to the multifunction peripheral, but may be, for example, a printer, a facsimile machine or a copier.

[Image Reading Portion 10]

The image reading portion 10 includes: a contact glass 11 constituting an original mounting surface; and an original cover 20 that can be opened and closed against the contact glass 11. When the image forming apparatus 1 functions as a copier, the original cover 20 is closed after an original sheet is set on the contact glass 11, and subsequently a copy start instruction is input from an operation panel (not shown), the image reading portion 10 starts a reading operation to read image data from the original sheet. Inside the image reading portion 10, optical devices, such as a reading unit 12 including an LED light source 121 and a mirror 122, mirrors 13 and 14, an optical lens 15, and a CCD 16, are provided. When the reading unit 12 is moved by a motor or the like in a vertical direction 45, and light irradiated from the LED light source 121 toward the contact glass 11 is scanned in the vertical direction 45, the reflection light is input into the CCD 16. This enables the image to be read from the original sheet on the contact glass 11.

Note that an ADF 21 is provided in the original cover 20. The ADF feeds a plurality of original sheets set on an original setting unit 21A sequentially by using a plurality of transport rollers (not shown). With this operation, the ADF 21 moves the original sheets such that the original sheets pass a predetermined reading position provided on the contact glass 11, rightward in the vertical direction 45. When the ADF 21 moves an original sheet, the reading unit 12 is arranged below the reading position and reads the image from the original sheet at this position while the original sheet is moving.

[Image Forming Portion 22]

Figure 2:
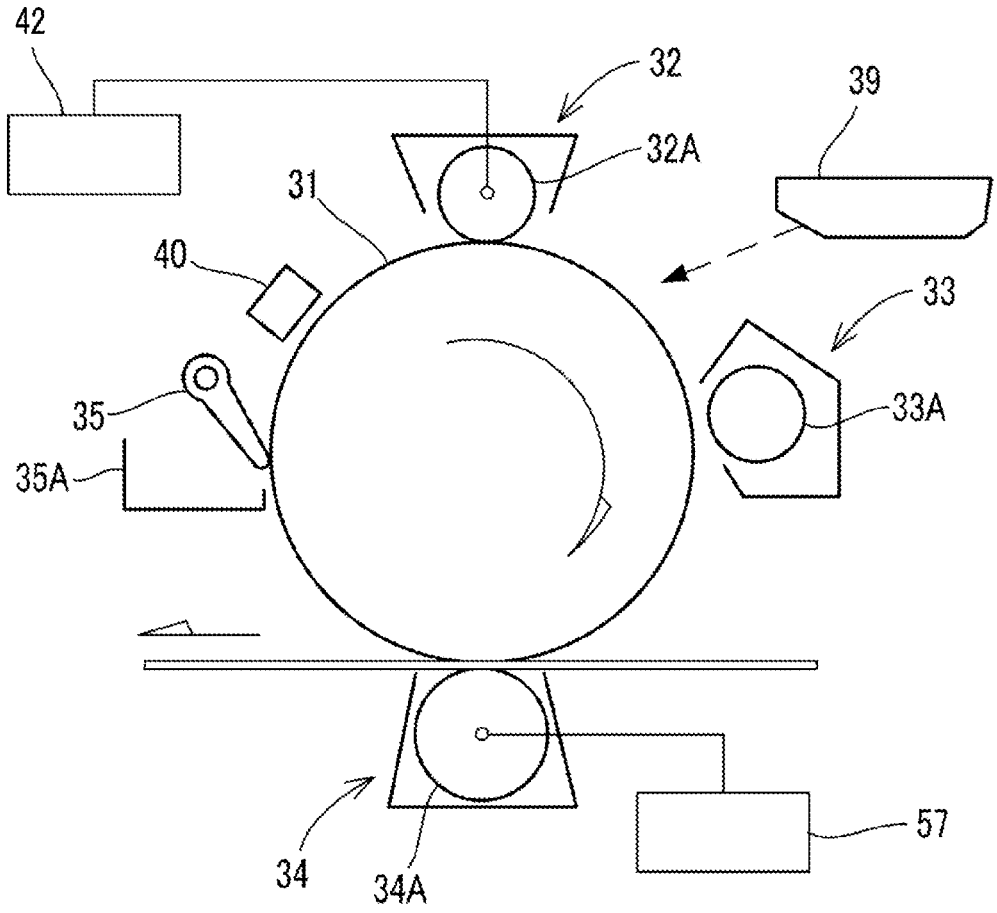
FIG. 2 is a diagram showing the structure of devices arranged around the photosensitive drum of the image forming apparatus shown in FIG. 1.

The image forming portion 22 performs an image forming process (printing process) based on the electrophotographic method. The image forming portion 22 performs the image forming process based on image data read by the image reading portion 10, or based on image data input from an external information processing device. As shown in FIGS. 1 and 2, the image forming portion 22 includes a plurality of paper feed cassettes 25, a photosensitive drum 31 (an example of the image carrier of the present disclosure), a charging device 32, a developing device 33, a transfer device 34, a cleaning blade 35, an electricity removing device 40, a fixing device 36, an exposing device 39, an ejected paper tray 27 and the like.

As shown in FIG. 2, the image forming portion 22 further includes: a transfer voltage supplier 57 for supplying a transfer voltage to the transfer device 34; and a charging voltage supplier 42 for supplying a DC voltage for charging to the charging device 32.

As shown in FIG. 1, the paper feed cassettes 25 are provided in the lower portion of the image forming portion 22. In the present embodiment, three paper feed cassettes 25 are arranged in the vertical direction. A plurality of sheets of printing paper (sheets of materials) are stacked and housed in each of the paper feed cassettes 25. The printing paper sheets housed in the paper feed cassettes 25 are fed one by one by the feeders 17 including feeding rollers and the like and transported toward the transfer device 34 via a transport path 18 inside the image forming portion 22.

As shown in FIG. 2, the photosensitive drum 31 is a rotary body formed in the shape of a drum, and is rotatably supported by a frame or the like provided inside the image forming portion 22. A bias voltage is applied to the photosensitive drum 31 by the charging device 32, which is described below, so that the outer circumferential surface of the photosensitive drum 31 is charged to a predetermined potential. The photosensitive drum 31 receives transmission of a rotation driving force from a driving source such as a motor (not shown) and is rotated in a clockwise rotation direction as shown in FIG. 2 (the direction indicated by the arrow). The photosensitive drum 31 has a structure where a single photosensitive layer is formed on the surface thereof. More specifically, the photosensitive drum 31 has a single-layer structure of a photosensitive layer that is deposited by vapor deposition, the photosensitive layer being made of an organic photo conductor composed of an organic compound whose conductivity is increased when it receives irradiation of light. Of course, the photosensitive drum 31 may have a three-layer structure including: an undercoat layer; a charge generating layer; and a charge transport layer.

The charging device 32, developing device 33, transfer device 34, cleaning blade 35, and electricity removing device 40 are arranged along the outer circumferential surface of the photosensitive drum 31.

The charging device 32 is provided above the photosensitive drum 31 to face the outer circumferential surface of the photosensitive drum 31. The charging device 32 includes a charging roller 32A (an example of the conductive roller of the present disclosure) that rotates in contact with the outer circumferential surface of the photosensitive drum 31. When the charging voltage supplier 42 applies a predetermined DC voltage to the photosensitive drum 31 via the charging roller 32A, the photosensitive layer of the photosensitive drum 31 is charged uniformly so as to have a surface potential corresponding to the applied DC voltage. This causes a bias (potential difference) between the charging roller 32A and the photosensitive drum 31.

The developing device 33 is provided on the downstream side of the charging device 32 in the rotation direction of the photosensitive drum 31. The developing device 33 includes a developing roller 33A that has been charged to a potential lower than the surface potential of the photosensitive drum 31. That is to say, a bias (potential difference) has been generated between the photosensitive drum 31 and the developing roller 33A. The developing roller 33A is made of a conductive rubber material. Toner transported from a toner container (not shown) is supplied to the photosensitive drum 31 by the developing roller 33A. Note that the toner to be used may be a one-component developer composed of only toner, or a two-component developer which is a mixture of carrier and toner.

The exposing device 39 irradiates a laser beam from a space between the charging device 32 and the developing device 33 toward the photosensitive drum 31 so that the outer circumferential surface of the photosensitive drum 31 is exposed. With this operation, an electrostatic latent image is formed on the outer circumferential surface of the photosensitive drum 31 in accordance with image information contained in the laser beam. More specifically, when the laser beam is irradiated onto the outer circumferential surface of the photosensitive drum 31, the potentials of the portions exposed to the irradiated laser beam are discharged, and the laser-exposed portions form an electrostatic latent image. When toner is supplied to the photosensitive drum 31 by the developing device 33, the toner adheres to the electrostatic latent image by the electrostatic force that is caused by the potential difference between the electrostatic latent image and the toner.

The transfer device 34 is provided on the downstream side of the developing device 33 in the rotation direction of the photosensitive drum 31. The transfer device 34 is provided below the photosensitive drum 31 to face the outer circumferential surface of the photosensitive drum 31. The transfer device 34 includes a transfer roller 34A that rotates in contact with the outer circumferential surface of the photosensitive drum 31. The transfer voltage supplier 57 supplies a voltage corresponding to a predetermined current value to the transfer roller 34A. This causes the transfer roller 34A to be charged to a predetermined potential. That is to say, a bias (potential difference) is caused between the photosensitive drum 31 and the transfer roller 34A. The transfer roller 34A is made of, for example, a conductive rubber material. When a printing paper sheet is nipped by the photosensitive drum 31 and the transfer roller 34A in a nip portion formed between the photosensitive drum 31 and the transfer roller 34A, the toner of the photosensitive drum 31 adheres to the surface of the printing paper sheet.

As shown in FIG. 1, the fixing device 36 is provided on the downstream side of the transfer device 34 in the printing paper sheet transport direction. The fixing device 36 fixes the toner, which has been transferred on the printing paper sheet, to the printing paper sheet. The fixing device 36 includes a heating roller 38 and a pressing roller 37 that is arranged to face the heating roller 38. The toner having been transferred on the printing paper sheet is heated and welded to the printing paper sheet when it passes through the fixing device 36. The printing paper sheet having passed through the fixing device 36 is ejected into the ejected paper tray 27.

As shown in FIG. 2, the cleaning blade 35 is provided on the downstream side of the transfer device 34 in the rotation direction of the photosensitive drum 31. The cleaning blade 35 removes toner that has remained on the outer circumferential surface of the photosensitive drum 31 without being transferred onto the printing paper sheet. The cleaning blade 35 is made of silicone rubber and the like. The remaining toner is scraped off by the cleaning blade 35 into a toner receiver 35A when the photosensitive drum 31 rotates in contact with the cleaning blade 35.

The electricity removing device 40 is provided on the downstream side of the cleaning blade 35 in the rotation direction of the photosensitive drum 31. The electricity removing device 40 removes charge that has remained in the photosensitive layer of the photosensitive drum 31. The electricity removing device 40 may be any of various types of devices such as: a type that removes electricity by irradiating light uniformly onto the outer circumferential surface of the photosensitive drum 31; a type that removes electricity by the AC discharge; and a type that removes electricity by a conductive electricity removing brush.

Figure 3:
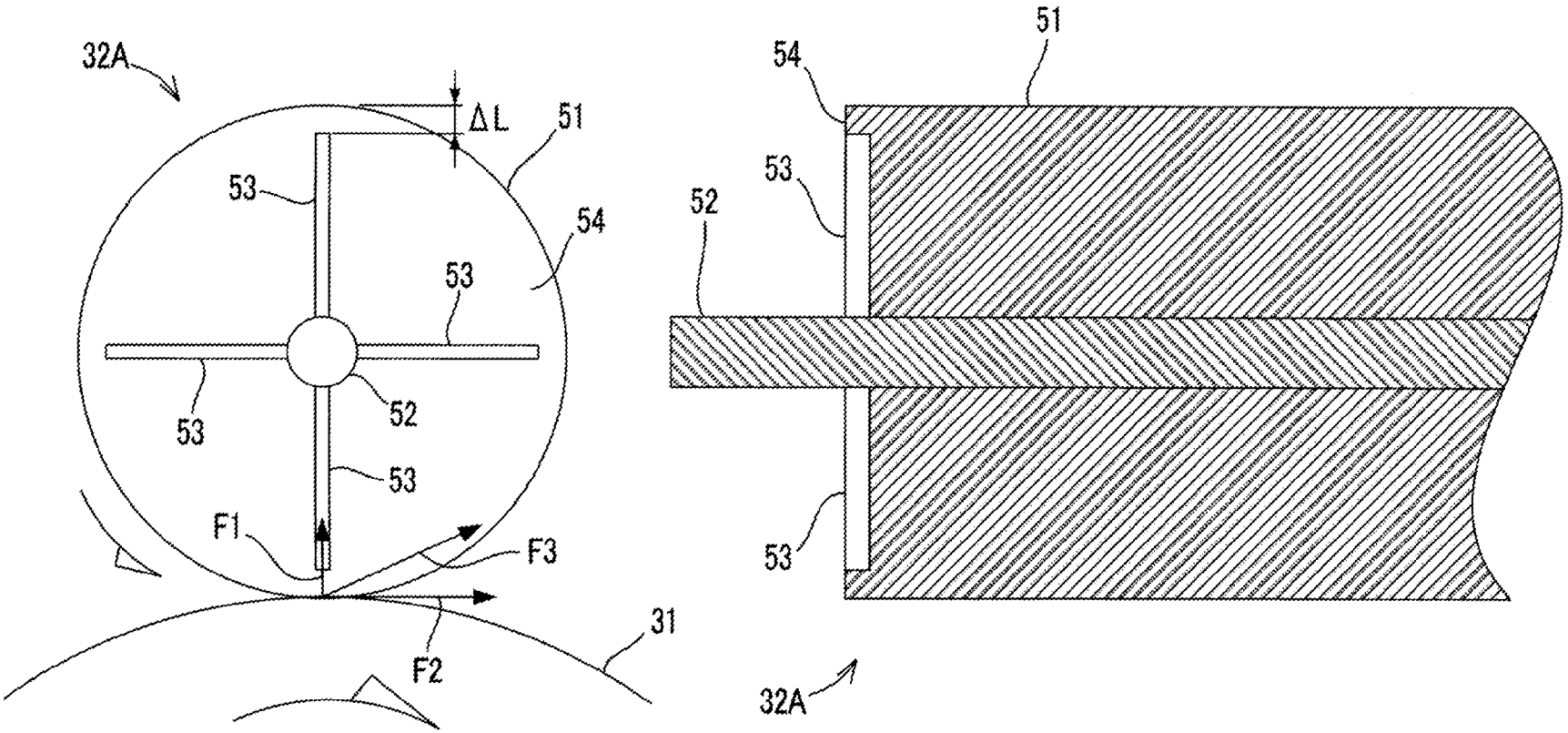
FIG. 3 is a diagram showing the structure of the charging roller provided in the charging device shown in FIG. 2.

Next, the structure of the charging roller 32A included in the charging device 32 is described in detail with reference to FIG. 3. FIG. 3 is a diagram showing the structure of the charging roller 32A. The left portion of FIG. 3 illustrates one side of the charging roller 32A. The right portion of FIG. 3 is a partial cross section of the charging roller 32A. Note that in FIG. 3, illustration of the structure of the other side of the charging roller 32A is omitted.

The charging roller 32A is an example of the conductive roller of the present disclosure. The charging roller 32A includes a roller body 51 (an example of the roller body of the present disclosure), a rotary shaft 52 (an example of the spindle of the present disclosure), and narrow grooves 53 (an example of the grooves of the present disclosure).

The roller body 51 is formed in a cylindrical shape. The roller body 51 contacts with the outer circumferential surface of the photosensitive drum 31 during the image formation, and is made of a conductive rubber material. More specifically, the roller body 51 is made of a material that is produced by adding a conductive material to a rubber material such as urethane rubber, silicone rubber, NBR, etc. The rotary shaft 52 is provided in the center of the roller body 51. In the present embodiment, the roller body 51 is attached along the outer circumferential surface of the rotary shaft 52.

The rotary shaft 52 is rotatably supported by a cabinet (not shown) that houses the charging roller 32A. The rotary shaft 52 is made of a conductive metal such as SUS, phosphor bronze, etc. A DC voltage from the charging voltage supplier 42 is supplied to the rotary shaft 52, and then is supplied from the rotary shaft 52 to the roller body 51. In a state where a voltage is applied to the charging roller 32A via the rotary shaft 52, the photosensitive drum 31 is rotated in the direction indicated by the arrow as shown in FIG. 3. Here, the charging roller 32A receives, from the photosensitive drum 31, a contact pressure (nip force) F1 in the radial direction (a direction perpendicular to the rotary shaft 52), and a frictional force F2 in a tangential direction at the contact point. A pressing force F3, which is a synthetic force of the two forces F1 and F2, is applied to the charging roller 32A. This causes the charging roller 32A to rotate in contact with the outer circumferential surface of the photosensitive drum 31 as the photosensitive drum 31 rotates. As a result, the outer circumferential surface of the photosensitive drum 31 is charged to a potential corresponding to the applied voltage.

As shown in FIG. 3, four straight narrow grooves 53 are formed in a side wall 54 of the roller body 51 at an end of the charging roller 32A in the axis direction of the rotary shaft 52. The narrow grooves 53 extend outward in the radial direction, namely toward the outer circumferential surface of the roller body 51, from the rotary shaft 52 that is in the center of the side wall 54. The four straight narrow grooves 53 extend radially outward in the radial direction from the rotary shaft 52. The narrow grooves 53 are arranged at equal intervals along the circumferential direction of the rotary shaft 52. In the present embodiment, four narrow grooves 53 are formed, and thus the narrow groove 53 are provided around the rotary shaft 52 at 45 degree intervals. Note that four narrow grooves are formed in the other side wall of the opposite side of the charging roller 32A in the same manner as the four narrow grooves 53 formed in the side wall 54.

Since such narrow grooves 53 are formed in the side wall 54, when the charging roller 32A receives the pressing force F3 in the rotation direction from the photosensitive drum 31 as it contacts with the photosensitive drum 31, the narrow grooves 53 are crushed. With this structure, even if the side portions of the roller body 51 at the opposite ends in the axis direction of the rotary shaft 52 are swollen in the radial direction, the swelling is absorbed by the grooves, wherein the grooves are crushed as much as the side portions are swollen. As a result, the pressing force applied to the photosensitive drum 31 becomes uniform, and thus the photosensitive drum 31 is charged to a uniform potential. That is to say, it is possible to cause a uniform bias between the photosensitive drum 31 and the charging roller 32A. Furthermore, since the narrow grooves 53 extend in the radial direction, current conduction paths for voltage are formed from the rotary shaft 52 to the surface of the roller body 51. That is to say, current conduction paths for voltage extending from the rotary shaft 52 to the surface of the roller body 51 are not interrupted. With this structure, the voltage is conducted to the surface of the roller body 51 along the side wall 54 through the current conduction paths that are not interrupted due to the narrow grooves 53. Accordingly, the current conduction path of the present disclosure is not longer than that of a typical case. For this reason, the current conduction efficiency is not decreased, and the potential of the roller body 51 continues to be sufficient. As a result, the voltage is applied without variation from the surface of the roller body 51 toward the photosensitive drum 31.

Furthermore, the narrow grooves 53 do not reach the surface of the roller body 51, but are formed up to a position before the surface of the roller body 51, namely up to a position with a predetermined distance $\Delta L$ from the surface of the roller body 51 toward the rotary shaft 52. Thus, between the extended ends of the narrow grooves 53 and the surface of the roller body 51, there are roller body portions having thickness $\Delta L$. This prevents occurrence of defects such as cracks at the extended ends of the narrow grooves 53 even when the narrow grooves 53 are repeatedly bent as the roller body 51 contacts with the photosensitive drum 31.

It should be noted here that the groove depth and groove width of the narrow groove 53 are elements that are determined based on the contact pressure between the charging roller 32A and the photosensitive drum 31, the rotational speed of the photosensitive drum 31, and the like. For example, according to the present embodiment, the narrow groove 53 may be set to have a groove depth of 1.0 mm to 5.0 mm and a groove width of 0.5 mm to 2.0 mm. Also, the distance ΔL is an element that is determined based on the size of the pressing force F3 received from the photosensitive drum 31, and the like. For example, according to the present embodiment, the distance ΔL may be set to be in a range from 1.0 mm to 5.0 mm.

Figure 4A:
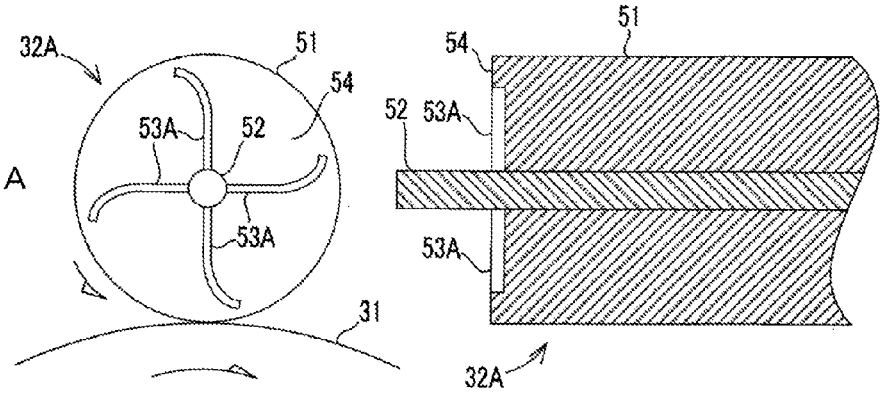
FIGS. 4A, 4B and 4C show other examples of the charging roller provided in the charging device shown in FIG. 2.

Note that although the present embodiment describes, as one example, the narrow grooves 53 that extend in the radial direction from the rotary shaft 52, the present disclosure is not limited to this structure. For example, as shown in FIG. 4A, the grooves of the present disclosure may be narrow grooves 53A that are curved along the direction in which the charging roller 32A receives the pressing force F3 (see FIG. 3) from the photosensitive drum 31 while they contact with each other. The narrow grooves 53A extend straight from the rotary shaft 52 in the radial direction and then only the extended ends thereof are curved along the pressure-receiving direction.

Figure 4B:
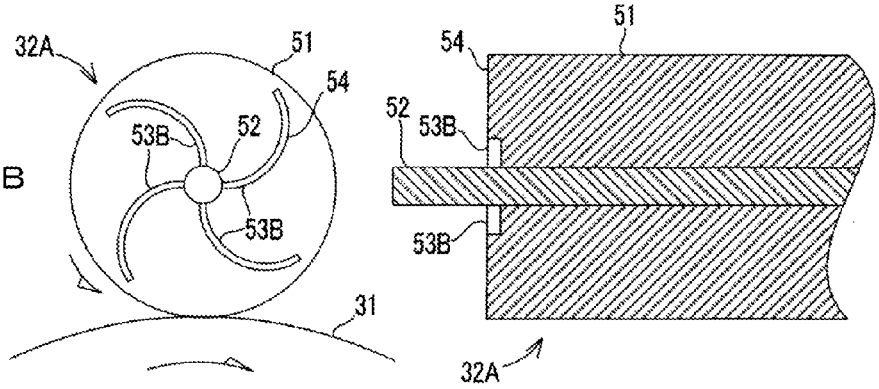

Also, as shown in FIG. 4B, the grooves of the present disclosure may be narrow grooves 53B that curve like arrows from the rotary shaft 52 along the pressure-receiving direction. With the structure of the narrow grooves 53A or 53B, when the charging roller 32A receives the pressing force F3 from the photosensitive drum 31, the narrow grooves 53A or 53B are more easily crushed and the swellings of the roller body at the opposite ends thereof are more easily absorbed by the grooves.

Figure 4C:
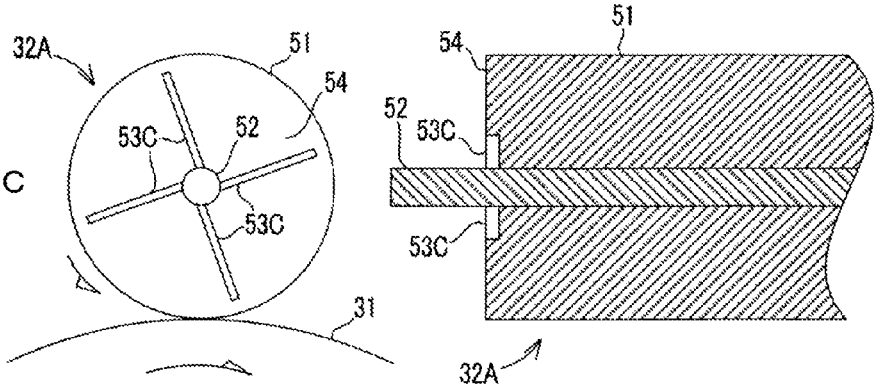

Also, as shown in FIG. 4C, the grooves of the present disclosure may be narrow grooves 53C that are slanted along the direction in which the charging roller 32A receives the pressing force F3 from the photosensitive drum 31 while they contact with each other.

Furthermore, although the present embodiment describes, as one example, four narrow grooves 53. However, not limited to this, less than four narrow grooves 53, 53A, 53B or 53C, or five or more narrow grooves 53, 53A, 53B or 53C may be formed.

Furthermore, the present embodiment describes the charging roller 32A, as one example of the conductive roller of the present disclosure. However, not limited to this, the present disclosure is applicable to the transfer roller 34A of the transfer device 34, or the developing roller 33A of the developing device 33 as well.

Furthermore, the present embodiment describes the image forming apparatus 1 including the charging roller 32A, as one example of the image forming apparatus of the present disclosure. However, not limited to this, the present disclosure may be realized as a stand-alone device such as the charging device 32 including the charging roller 32A, or as a stand-alone conductive roller such as the charging roller 32A.

Furthermore, the present embodiment describes the image forming apparatus 1 including the fixing device 36, as one example of the present disclosure. However, of course, the present disclosure is applicable to a stand-alone device constituted of only the fixing device 36.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A conductive roller comprising:

a roller body that contacts with an outer circumferential surface of an image carrier, and is conductive;

a spindle provided in a center of the roller body; and at least one groove that is an indented narrow groove formed in each side wall of the roller body at opposite ends in an axis direction of the roller body, extends outward in a radial direction from the spindle, and curves along a direction in which a pressing force is received from the image carrier upon contact with the image carrier.

2. The conductive roller according to claim 1, wherein the groove is formed up to a position with a predetermined distance from a surface of the roller body toward the spindle.

3. The conductive roller according to claim 1, wherein the at least one groove is a plurality of grooves that are formed in each side wall of the roller body, and extend outward in the radial direction from the spindle.

4. The conductive roller according to claim 1, wherein the at least one groove is a plurality of grooves that are arranged at equal intervals along a circumferential direction of the spindle.

5. An image forming apparatus comprising:

the conductive roller according to claim 1; and an image carrier that is charged by a voltage applied via the conductive roller.

* * * * *